United States Patent [19]

Tajima et al.

[11] Patent Number: 5,038,591

[45] Date of Patent: Aug. 13, 1991

[54] ROLLING MILL AND ROLLING MILL METHOD

[75] Inventors: Sadayoshi Tajima; Tadashi Hashimoto, both of Hitachi, Japan

[73] Assignee: Hitachi, Ltd., Tokyo, Japan

[21] Appl. No.: 296,832

[22] Filed: Jan. 13, 1989

[30] Foreign Application Priority Data

Jan. 14, 1988 [JP] Japan ..... 63-4732
May 13, 1988 [JP] Japan ..... 63-114680

[51] Int. Cl.[5] ..... B21B 31/30; B21B 31/32

[52] U.S. Cl. ..... 72/21; 72/238; 72/245; 72/241.2

[58] Field of Search ..... 72/245, 244, 238, 239, 72/199, 35, 21, 248, 241.2

[56] References Cited

U.S. PATENT DOCUMENTS

| | | | |
|---|---|---|---|
| 1,712,575 | 5/1929 | McArthur | 72/239 |
| 2,369,598 | 2/1945 | Misset | 72/248 |
| 3,355,925 | 12/1967 | Barnikel et al. | 72/244 |
| 3,572,079 | 3/1971 | Bond | 72/244 |
| 4,086,797 | 5/1978 | Vydrin | 72/245 |
| 4,167,107 | 9/1979 | Simmonds | 72/239 |
| 4,237,715 | 12/1980 | Lutz | 72/244 |
| 4,499,748 | 2/1985 | Nihei et al. | 72/247 |
| 4,751,837 | 6/1988 | Bonnenkamp | 72/244 |

FOREIGN PATENT DOCUMENTS

| | | | |
|---|---|---|---|
| 721951 | 6/1942 | Fed. Rep. of Germany | 72/244 |
| 66907 | 4/1984 | Japan | 72/238 |
| 60006 | 3/1988 | Japan | 72/238 |
| 2199274 | 7/1988 | United Kingdom | 72/244 |

*Primary Examiner*—Daniel C. Crane
*Attorney, Agent, or Firm*—Fay, Sharpe, Beall, Fagan, Minnich & McKee

[57] ABSTRACT

In addition to the usual type of screw-down mechanism, work roll gap is adjusted during work roll change for different diameter work rolls, without removing the back up rolls, by a variable height plate rotatably inserted between the back up roll chocks and the housing, which will minimize the volume of oil contained within the screw-down adjustment rams while maintaining good rigidity for the plate adjustment even during high impact and high vibration hot rolling. A similar effect is provided by containing unused plate height portions entirely within the footprint of the housing where they can be rigidly supported. Further rigidity is obtained with minimizing the volume of fluid within the rams, accomplished by placing the valve stand immediately adjacent to the hydraulic rams for the screw-down and preferably on top of the housing. The roll change height adjustment provided by the plates, as opposed to a bulky screw-type adjustment, provides for a reduced height housing and the additional room for the valve stand.

37 Claims, 7 Drawing Sheets

ROLLING MILL AND ROLLING MILL METHOD

BACKGROUND OF THE INVENTION

The present invention relates to metal rolling mills, particularly to roll gap adjustment during rolling and during work roll change.

SUMMARY OF THE INVENTION

It is an object of the present invention to improve existing rolling mills with respect to both work roll gap adjustment during rolling and work roll gap adjustment after the change of work rolls without removing the back up rolls.

In addition to the usual type of screw-down mechanism, work roll gap is adjusted during work roll change for different diameter work rolls, without removing the back up rolls, by a variable height plate rotatably inserted between the back up roll chocks and the housing, which will minimize the volume of oil contained within the screw-down adjustment rams while maintaining good rigidity for the plate adjustment even during high impact and high vibration hot rolling. A similar effect is provided by containing unused plate height portions entirely within the footprint of the housing where they can be rigidly supported. Further rigidity is obtained with minimizing the volume of fluid within the rams, accomplished by placing the valve stand immediately adjacent to the hydraulic rams for the screw-down and preferably on top of the housing. The roll change height adjustment provided by the plates, as opposed to a bulky screw-type adjustment, provides for a reduced height housing and the additional room for the valve stand.

BRIEF DESCRIPTION OF THE DRAWING

Further objects, features and advantages of the present invention will become more clear from the following detailed description of a preferred embodiment, shown in the accompanying drawing, wherein.

DETAILED DESCRIPTION OF THE DRAWING

Figure 8:
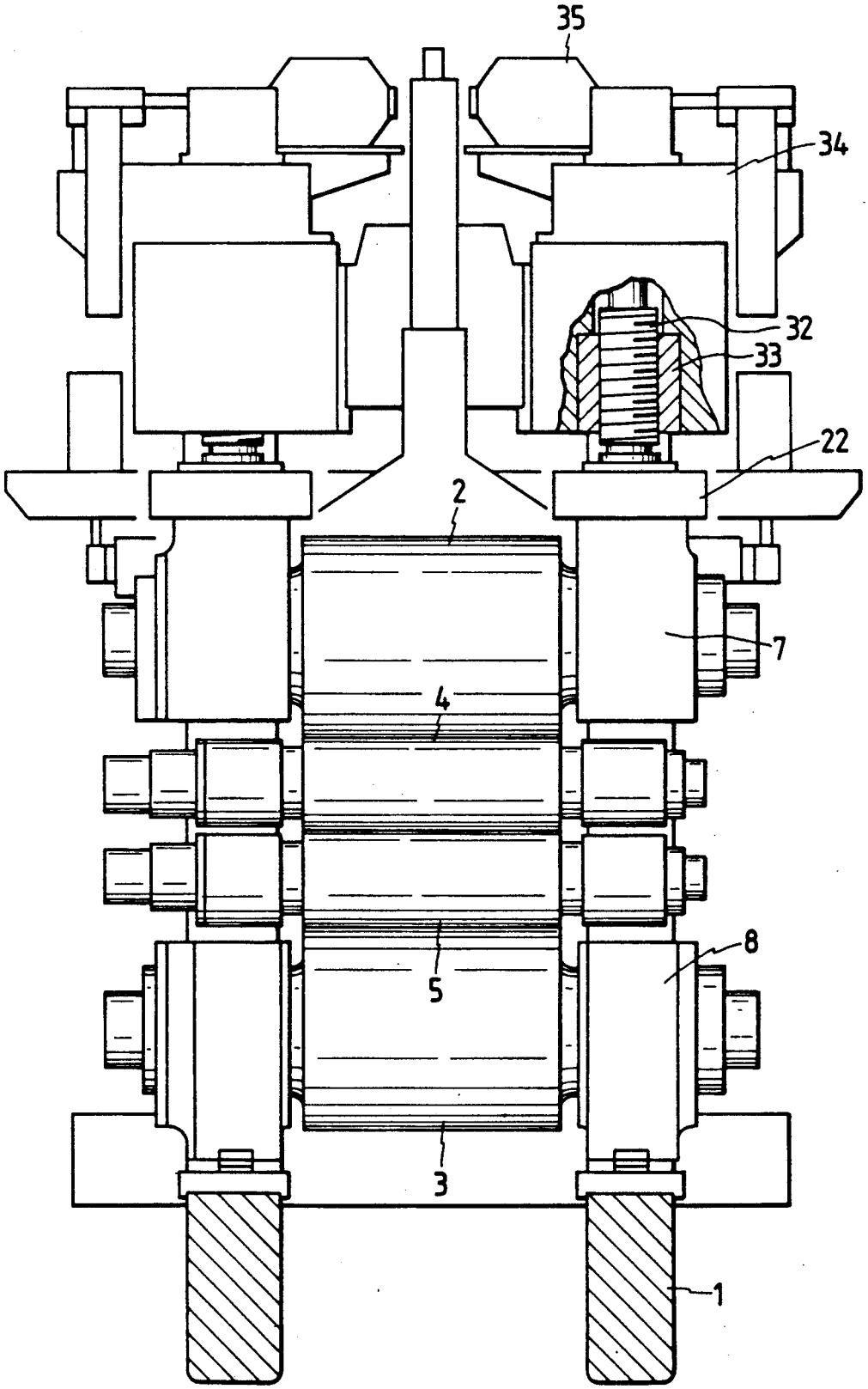
FIG. 8 is a cross sectional view useful in explaining problems relating to the prior art and a conceptional portion of the present invention.

FIG. 8 involves an analysis of a typical type of conventional rolling mill structure, for example as shown in Japanese Patent Publication No. 16706/1987. The rolling mill employs a rigid housing 1 containing therein work rolls 4, 5 defining therebetween a gap for the material to be rolled. The work rolls are supported by backup rolls 2, 3, respectively having backup roll chocks 7, 8 at their opposite ends. The backup roll chocks are supported within the housing 1. During rolling, adjustment is made by means of a hydraulic ram 22 mounted between each of the roll chocks 7 and the housing to constitute normal screw-down adjustment. During change of work rolls, adjustment is made for different size work rolls by means of an additional adjustment mechanism employing an axially movable screw 32 rotationally meshing with a rotationally and axially fixed nut 33, with the screws 32 being driven by a motor 35 through a large scale driving mechanism 34, which might contain various gearing. The mechanism 32, 33, 34, 35 thereby provides for adjustment during work roll change and limits the oil height change on the hydraulic cylinder resulting from variation in roll diameter. However, the roll reduction screw 32 and the nut 33 must have a high rigidity in order to withstand the rolling load, particularly the greater rolling load of hot rolling to be described later. Therefore, a hole through the housing 1 must be provided in order to store the work roll diameter adjustment mechanism 32–35 and provide the necessary rigidity. Moreover, the large scale driving mechanism 34 for driving the screw 32 by the motor 35 must be provided at the upper or lower part of the rolling mill, and therefore the installation cost of the roll reduction device and the overall cost of the rolling mill becomes enormous, as well as greatly increasing the height of the rolling mill. Because of this high rigidity, the driving mechanism 34 and the motor 35 must be quite large and of high capacity, as is obviously the screw 32 and nut 33.

In addition to the mechanism shown in FIG. 8, there is a similar type of rolling mill wherein the mechanism 32, 33, 34, 35 is replaced by a stepped height linear plate mounted between the hydraulic ram 22 and the housing 1, to provide for the rigid adjustment for the change in working roll diameter when work rolls are changed, particularly without removing the backup rolls. However, such a linear array of different height plate portions extends in a cantilevered fashion outwardly from the housing 1, from each axial end with respect to the axes of the rolls, therefore this cantilevered structure is relatively weak. As a result, this type of cantilevered stepped plate is usable only in cold rolling. This is true, because cold rolling rolls an indefinite length strip of steel fed from a coil at one end and wound at a coil on the other end of the mill, with a generally uniform reduction in strip thickness. The structure of the cantilevered linear stepped plate cannot be used in hot rolling. This type of mechanism is disclosed in Japanese Utility Model Publication No. 36326/1982, which specifically discloses the stepwise adjustment plate at the upper part of the rolling mill and the hydraulic cylinder at the lower part of the rolling mill. High impact develops in the hot rolling mill at the time of the catch and moving out of the rolling material, so that practical utilization cannot be made with an acceptable degree of safety. Furthermore, since an upper space is necessary for the rolling mill on the driving side, maintenance of lower equipment such as work roll driving spindles cannot be made. For these reasons, the device cannot be used for hot rolling.

Figure 9:
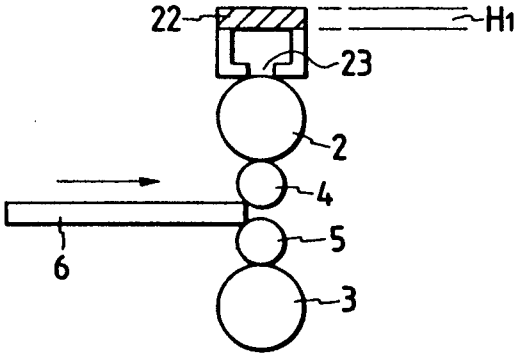
FIG. 9 schematically shows a roll stand with the entry of plate steel during hot rolling.
Figure 10:
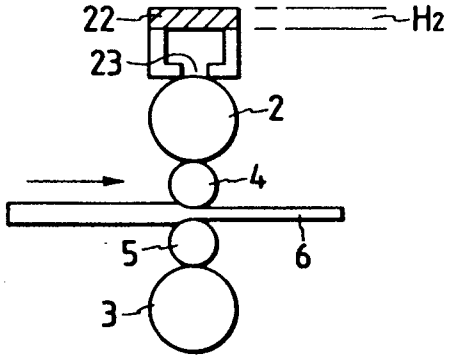
FIG. 10 is a view similar to FIG. 9, but showing the hot rolling of the plate in its middle.
Figure 11:
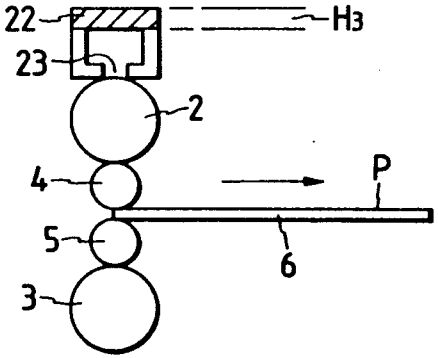
FIG. 11 is a view similar to FIGS. 9 and 10 but showing the rolling of the trailing edge of the plate.
Figure 12:
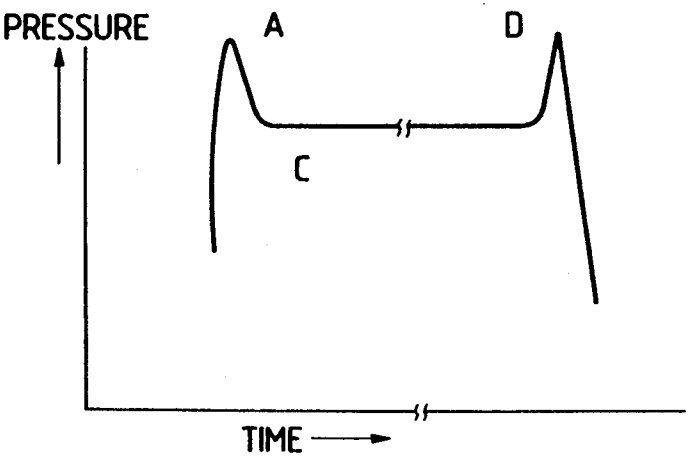
FIG. 12 is a plot of ram pressure vs. time for the rolling according to FIGS. 9–11.

This can be further appreciated with respect to a discussion of FIGS. 9–11. FIG. 9, the plate of metal, particularly steel, is of definite length so that its leading end enters the gap between the work rolls, to produce a sudden change in height of the hydraulic ram H1, and therefore corresponding change in hydraulic volume and corresponding change in hydraulic pressure as shown at point A in the plot of FIG. 12. This rather extreme change in ram height and change in pressure is due not only to the sudden entrance of the plate between the work rolls, but also due to the fact that the leading edge, merely by being an exposed edge, is considerably colder and therefore considerably harder than the interior portion of the plate P shown in FIG. 9 moving in the direction of the arrow. During the hot rolling of the mid portion of the plate P, the height of the fluid within the hydraulic ram is H2. Since there is no sudden change in plate thickness and the mid-portion of the plate is being rolled and is considerably hotter and less hard than the end portions, pressure within the hydraulic ram is in the region C shown in FIG. 12. When the cold trailing edge of the plate P enters between the work rolls, the height of the fluid within the hydraulic ram changes to H3 and the pressure within the hydraulic ram increases to pressure maximum D as shown in FIG. 12. The change in ram height or hydraulic fluid height within the ram and the change in pressure at the leading and trailing edges is almost entirely due to the difference in temperature between the leading and trailing edges in the mid portion of the plate, so that effectively pressure A equals pressure D, and H1 equals H3. The difference between H1 and H2 is substantially equal to the difference between H3 and H2, and is referred to as the sink. The entry of the leading edge in the gap between the work rolls is referred to as bite-in, and the exit of the trailing edge from the work roll gap is referred to as tail-out. It can be appreciated from the discussion of FIGS. 9–12 that high impact is involved and therefore high vibrations are involved with hot rolling. It is for these reasons that the cantilevered stepped plate structure of the prior art cannot be used in hot rolling.

There is a further disadvantage to the step-wise plate adjustment that is cantilevered from the rolling mill according to the prior art, in that due to the cantilevered nature, there is insufficient room for a large number of step adjustments, so that the number of adjustments is relatively small and therefore the stroke of the hydraulic cylinder cannot be reduced sufficiently by this mechanism.

As a further alternative, a hydraulic type screw down adjustment may be provided as the only adjustment mechanism so that it must make all adjustments for a change in work roll diameter. This has been the case with respect to cold rolling in the past. As can be appreciated, the volume of hydraulic fluid within the ram becomes relatively great corresponding to the relatively great displacement of the ram needed to not only provide the usual screw down type adjustment but also to provide for the change in work roll diameter during change of work rolls. While this may be adequate for cold rolling, it is not an adequate structure for hot rolling. Again this is due to the analysis set forth with respect to FIGS. 9–12. In hot rolling, with the only adjustment being the hydraulic ram, the larger volume of fluid means that there is an even greater sink than discussed with respect to FIG. 8 and therefore there occurs a large variation in the thickness of the rolled material and the result is an off gage product that cannot be approved as an end product. Accordingly, such a structure is not suitable for hot rolling and in hot rolling it is necessary to reduce the stroke of the hydraulic cylinder so that the sink of the hydraulic cylinder can be reduced as much as possible in order to minimize the thickness variation of the hot rolled material by maximizing the rigidity of the roll stand.

In summary, the prior art involving hydraulic screw down adjustment and a screw and nut work roll diameter adjustment has a large installation scale and installation cost, and expenses such as the large electric power for driving the screw are enormous. Further, the height of such a mechanism is so great, requiring such great height in the housing, that the hydraulic valve stand must be located at a distance quite far removed from the hydraulic ram. Particularly, the valve stand is usually located on a different floor, usually beneath, the rolling mill. This greatly increases the length of the hydraulic lines leading between the valve stand that controls the hydraulic ram and the hydraulic ram itself, which as can be appreciated greatly increases the volume of hydraulic fluid undergoing expansion and contraction, particularly during the high impact of hot rolling as described with respect to FIGS. 9–12.

The other prior art involving the cantilevered linear array of different plate thicknesses greatly increases the horizontal dimension of the roll stand in the axial direction so that it cannot be safely used as a rolling mill. This great overhang, in the axial direction, will interfere with other procedures around the rolling mill, such as roll changing, and the like. Furthermore, the cantilever structure is inherently weak and cannot be used for hot rolling that involves the high impact and high vibrations as described with respect to FIGS. 9–12, particularly with respect to the high impact at the time of catch and tail departure of the rolling produce. That is, there is not sufficient safety in the use of this device, particularly for hot rolling. Great overhang will also interfere with crane operation for lowering devices, so that certain operations cannot be carried out and there is a problem with respect to maintenance, particularly with change in work rolls, change in backup rolls, change in spindles, and the like.

Further, the problem of the distance between the hydraulic ram for the screw down mechanism and the valve stand for controlling such hydraulic ram, involving a large volume of hydraulic fluid, is solved with the present invention by moving the valve stand closely adjacent to the hydraulic ram. Particularly, when a step type plate or the like is employed, which inherently has a low height, sufficient height is saved in the overall rolling mill housing that the valve stand may be located on top of the housing, which would be impossible with a high height type of device as shown in FIG. 8. With a location for a valve stand, the hydraulic ram is preferably between the upper backup roll and the housing. With such a reduction in hydraulic fluid volume, the response speed can be improved remarkably and the controllability of the sheet shape is also improved remarkably. All of this is particularly true with respect to hot rolling.

The problems with respect to the cantilevered linear array of different height portions is solved by having the plate portions in an endless array, particularly in a rotatable plate or other type of endless conveyer so that they may be arranged horizontally closer to the backup roll chocks, and further more rigidly supported. Further, a greater number of step heights may be employed as a result. It is particularly advantageous, according to the present invention to arrange the array of different height plate portions within the footprint of the housing where they may be rigidly supported by the housing, all to provide high rigidity, particularly for hot rolling. Such an annular array of the stepped plate portions or containing the stepped plate portions entirely within the footprint of the housing further lessens the overhanging structure that will interfere with maintenance operations, such as crane operations.

In the description in the various figures, like numerals have been employed for like parts.

Figure 1:
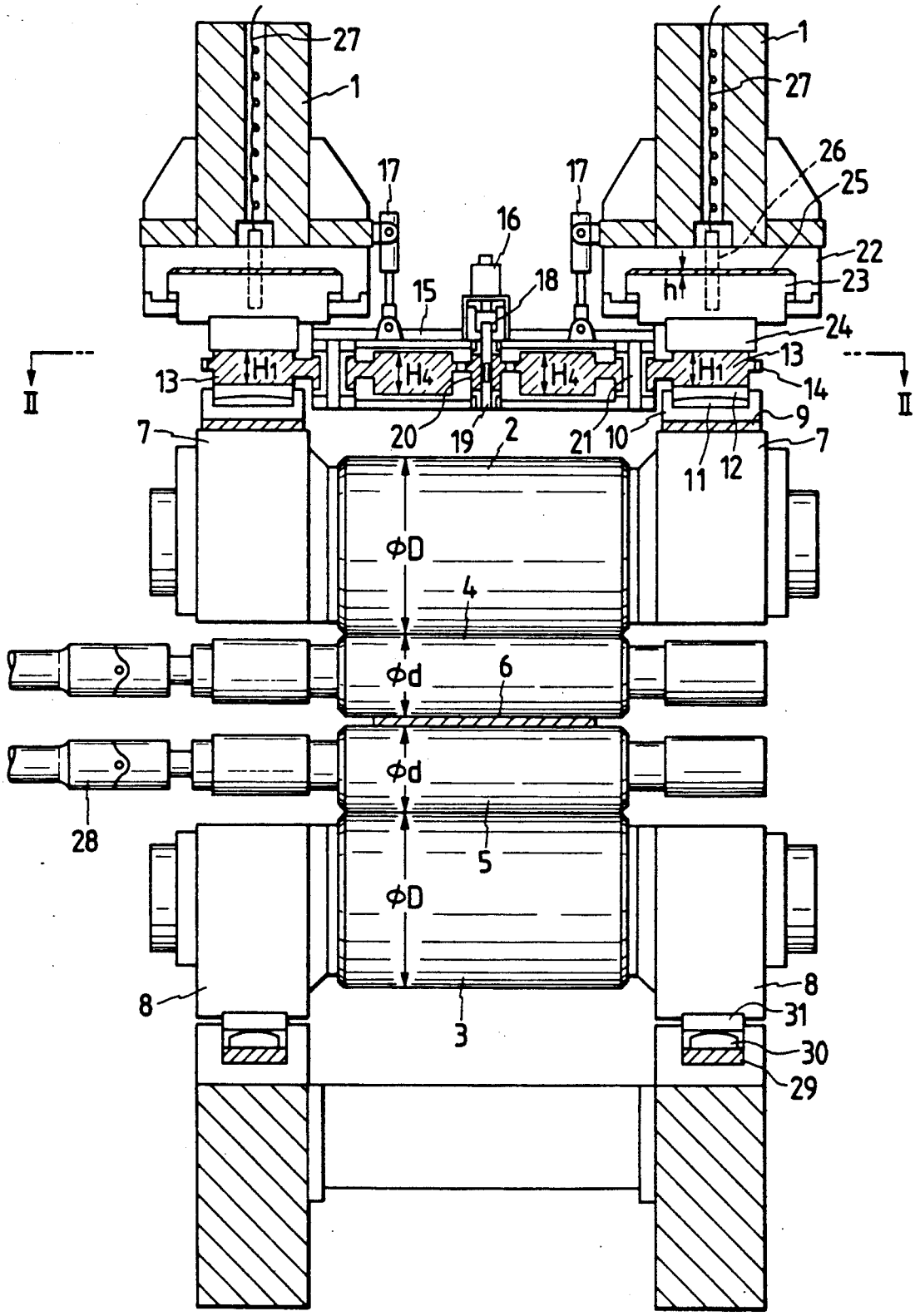
FIG. 1 is a cross-sectional view of a roll mill stand according to the present invention.

In FIG. 1, upper work roll 4 and lower work roll 5 form therebetween a gap for hot or cold rolling a product 6, with rotation of the work rolls being provided by drive spindles 28 in a conventional manner. The rolling load that develops at the time of rolling is born by the housing 1 through bearing boxes or roll chocks 7, 8, respectively supporting for rotation the opposite ends of the upper and lower backup rolls 2, 3. Between each of the roll chocks 7, there is a screw down adjustment hydraulic ram 23 provided within a hydraulic cylinder 22 having therebetween operating oil or hydraulic fluid 25 of a height within the cylinder h. According to a broader aspect of the present invention, the hydraulic rams may be provided between the roll chocks 8 and the housing 1. For adjustment purposes, for example when changing backup rolls, liners 9 between upper backup roll chocks 7 and the housing 1 are provided as well as liners 29 between the lower backup roll chocks 8 and the housing 1. Between the upper backup roll chocks 7 and the housing 1, there is also provided an adjustment mechanism comprising complimentary spherical plates 11, 12 that will provide for roll bending in a known manner, and similarly between the lower backup roll chocks 8 and the housing 1, there are provided complimentary supports comprising a rocker seat 31 and a rocker plate 30. A storage case 10 houses the spherical plates 11, 12 and a similar storage case houses the rocker seat 31 and rocker plate 30. The backup roll have a diameter D, whereas the work rolls have a diameter d.

Figure 2:
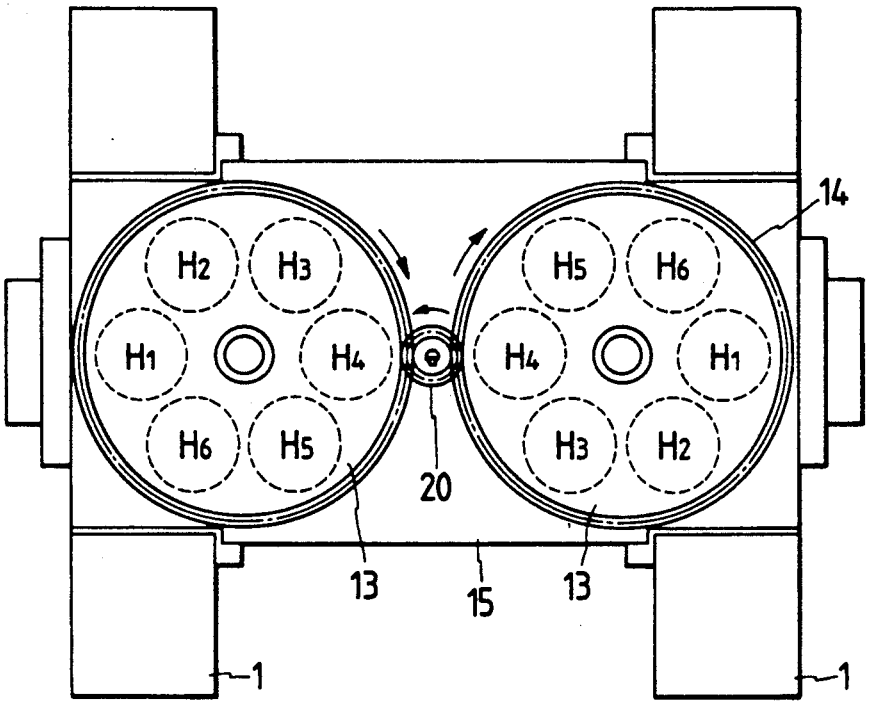
FIG. 2 is a schematic view taken along line II—II in FIG. 1.

A novel portion of the rolling stand shown in FIG. 1 involves adjustment for change in work roll diameter, particularly without removing the backup rolls. This is desirable, because work rolls are changed far more frequently than backup rolls, and a large amount of time is involved in changing backup rolls, so that if backup rolls do not have to be changed during change of work rolls, the time saving is obvious. With reference to FIGS. 1 and 2, two identical step plates or discs 13 are provided in the same plane adjacent each other, and each is provided with a peripheral ring gear 14 meshing with a common pinion gear 20. The plates 13 are rotatably mounted through 360 degrees of rotation through rotation of the pinion gear 20, which is driven by a motor 16 through a driving shaft 19 and an axial joint 18. Since this adjustment is conducted with the rolling mill stopped and since the gears and motor do not have to absorb any rolling forces, it is seen that the gears 14, 20 and driving mechanism including the motor 16 are very small, of light weight, of cheap construction, and require low power as compared to the screw, nut and electric motor adjustment of the FIG. 8 device. Each plate 13 is provided with a plurality of different height plate portions H1, H2, H3, H4, H5, H6, for example in an annular array or endless array, so that by rotation of the plate 13, any one of these different height or thickness plate portions may be effectively placed between the adjacent backup roll chock, particularly roll chock 7, and the housing 1 to compensate for a roll diameter change d for the work rolls. Each of the plates 13 is provided with a support shaft 21 rotatably mounted with respect to the housing 1.

The rotary type stepped plates are preferably stored in a case 15 that is supported by a balance cylinder 17, in the vertical direction, in such a manner as to follow the motion of the hydraulic ram 23. The hydraulic cylinder 22 is fixed onto the upper surface of the rolling mill housing 1 and transmits the rolling load to the housing 1 through the operation of the hydraulic oil 25. A rolling reduction sensor 26 for the ram 23 is assembled in the hydraulic cylinder 22 and its electric signal is connected to outside through a cable 27, to provide for measurements and control and the work gap, with the other controls being conventional.

The operation of the above described structure is as follows. When the roll diameter d of the work rolls 4, 5 and the roll diameter D of the backup rolls change, the difference of the diameters of the upper and lower backup rolls is adjusted by adjusting the thickness of the liners 9, 28, to compensate for the difference in diameters D of the backup rolls 2, 3, respectively.

On the other hand, the rearrangement or change frequency of the work rolls 4, 5 is very much higher than that of the backup rolls 2, 3. Therefore, the change in diameter d of the work roll diameters cannot be adjusted by the liners 9, 28. Therefore, the present invention provides for a selection of any one of the different height plate portions H1–H6 arranged on the disc 13, as specifically shown in FIG. 2, by the rotary type stepped plate 13. Therefore, an appropriate thickness is selected among the different height plate portions H1–H6 in accordance with the change in work roll diameter. This is accomplished, of course, through rotation of the motor 16 and consequently rotation of the disc 13 to move the appropriate height portion of the plates 13 between the backup roll chocks 7 and the housing 1 to be clamped by the hydraulic cylinder. Thereby, the selected plate portion among the plate portions H1–H6 has high rigidity and minimizes the oil column height h between the hydraulic cylinder 22 and the ram 23, to maximize mill rigidity and reduce sink. In this manner, the sink of the hydraulic cylinder due to the peak load at the time of catch of the front ends moving out of the rolled material, particularly with respect to hot rolling, can be minimized so the accuracy of the thickness of the products can be secured. If the variation of the work roll diameter d is corrected only by the change of the oil column of the hydraulic cylinder without using a stepped type of plate, the oil column must be at least 160 mm because the use range of the work rollers in a hot strip mill having a work roll diameter of 800 mm is generally from 800 mm to 720 mm, with a difference of 80 mm for each work roll, so that with two work rolls we obtain the maximum range of 160 mm for adjustment. If the stepped plate of the present invention, particularly the rotary type, is employed with five steps, it is seen that 160/5 mm is equal to 32 mm for a difference in height of the various height portions of the stepped plate and the sink quantity due to the oil column can be simply reduced correspondingly by 1/5th so that off gauge of the roll products is decreased accordingly. It is therefore obvious that the rotary type stepped plate of the present invention contributes to the improvement of the production yield.

When the work rollers 4, 5 are changed, again they must be secured between the backup rolls 2, 3. If the thinnest stepped plate, for example H6, among the rotary type stepped plates 13 is selected and inserted, the gap between the rollers can be set rapidly for the arrangement of the work rolls and the work roll replacement time can be shortened so that the rolling efficiency can be improved remarkably.

It is of course possible, as a modified portion of the present invention, to employ a rotary type step plate at the lower part of the roll stand, for example between backup roll chocks 8 and the housing 1. While only two backup rolls have been specifically shown for a high rolling mill, the present invention is equally employable with additional backup rolls of various known configurations, so long as the plate adjustment is effectively between the backup rolls and the housing.

The present invention does not require conventional electric roll-reduction screw for compensating the change in work roll diameters and its great installation and operating costs as well as its great space requirements. Also, the present invention reduces the front and rear end off gauge caused by the sink of the oil column in the hydraulic ram and greatly reduces the time for work roll replacement.

Figure 4:
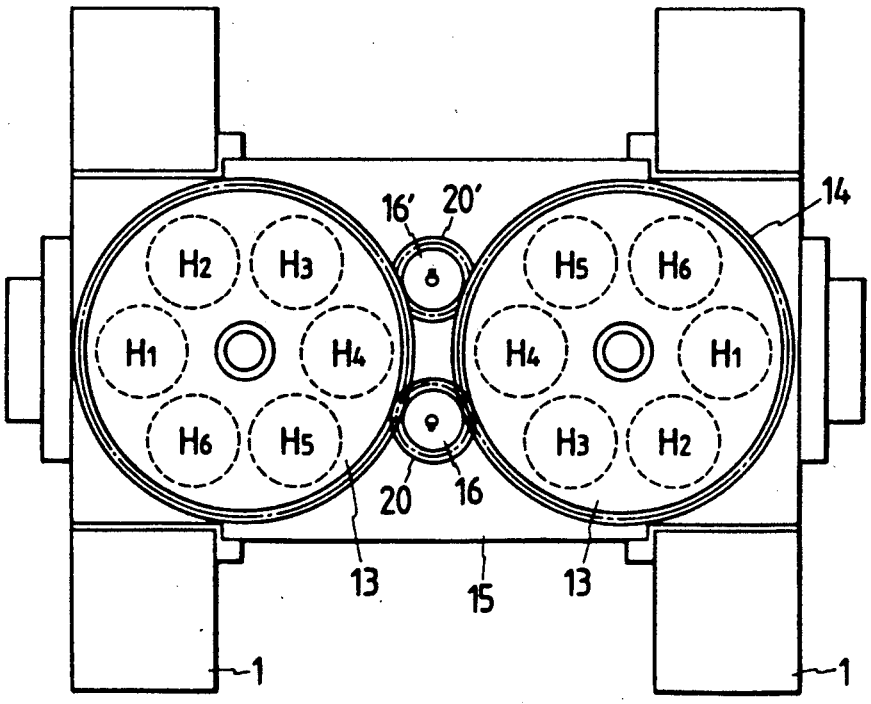
FIG. 4 is a view similar to FIG. 2 but taken along line IV—IV FIG. 3.
Figure 3:
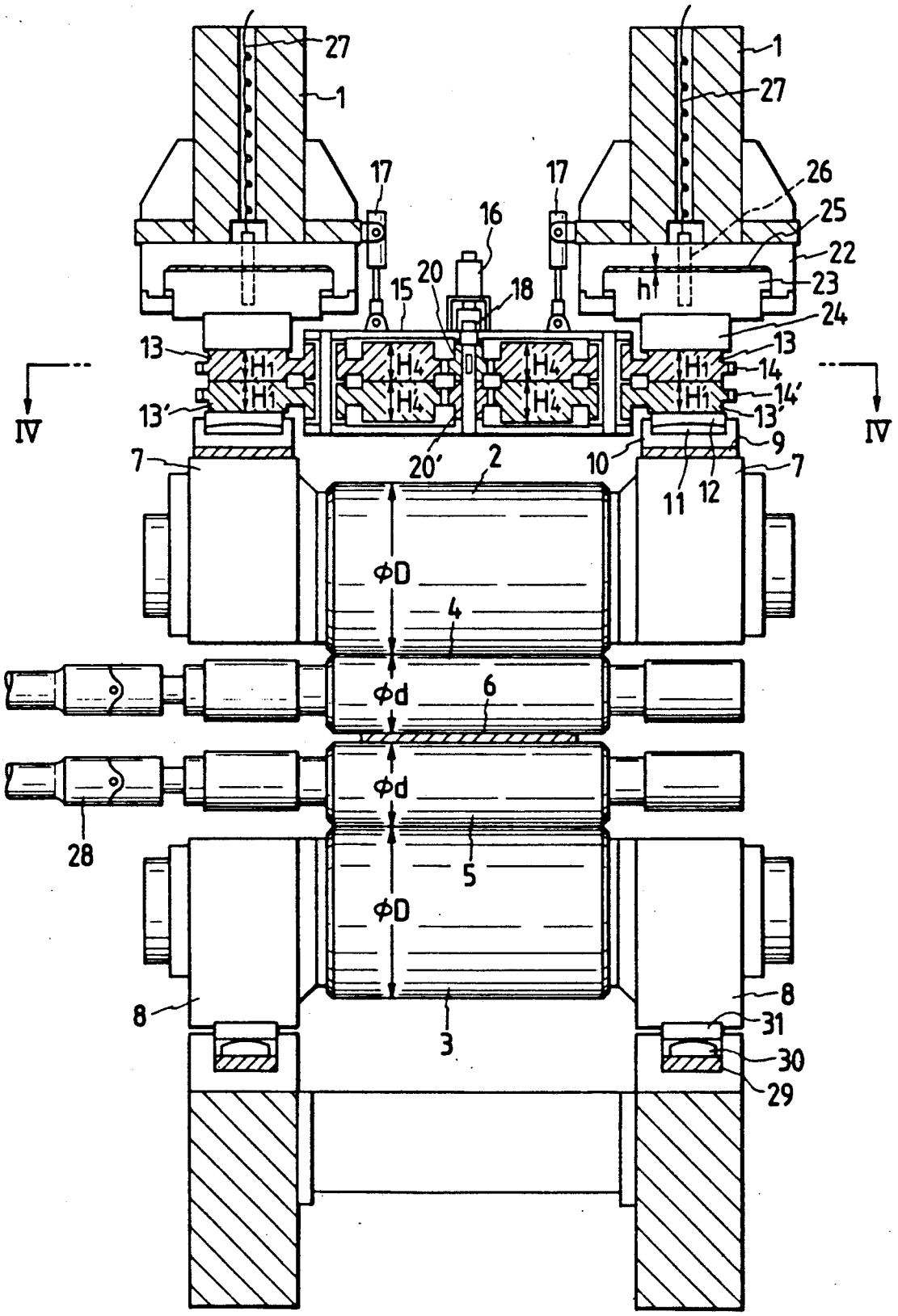
FIG. 3 is similar to FIG. 1, with additional plate adjustment.

The described roll mill structure of FIGS. 1 and 2 can be provided in combination with tandem plate adjustment according to FIGS. 3 and 4. Additional plates 13', and driving mechanism including motor 16' are provided in tandem to the previously described basically identical plates 13 and driving mechanisms including motor 16. Motor 16' correspondingly will rotate plates 13', while motor 16 will rotate plates 13 as previously described. Additional plates 13' are contained in the same casing as the plates 13 and supported in the same manner. Thus, the stepped plates 13' are capable of turning independently from the rotary step plates 13, because the motor 16' is associated with the driving pin 20' that engages only the ring gear 14' of the stepped plates 13'. In contrast to the six thickness adjustments provided by the plates H1–H6 in FIG. 1 and FIG. 2, adjustment provided by FIGS. 3 and 4 is six times six or 36 step adjustments to provide for finer thickness adjustment, that is more steps. Therefore, since the change h of the oil column of the hydraulic cylinder 22 can be reduced with a tandem construction of FIGS. 3 and 4 as compared to the structure of FIGS. 1 and 2, by the provision of more plates, the rolling of products having a superior thickness accuracy is obtained. Though the number of steps of the stepped plate 13 and 13' is 6, in the preferred embodiment, it is possible to employ an arbitrary number of steps. Furthermore, height adjustment can be made without any steps by providing the plates of an inclined or wedge construction for the plates 13 of FIG. 1 or for the plates of 13 and 13' of FIGS. 3 and 4, to provide for an infinitely variable adjustment. For example, only the top surface of the plate 13, in FIGS. 1 and 2 could be inclined with the bottom surface being entirely horizontal, so that the correspondingly inclined surface on the force plate 24 will provide for infinite adjustment instead of step wise adjustment.

Figure 5:
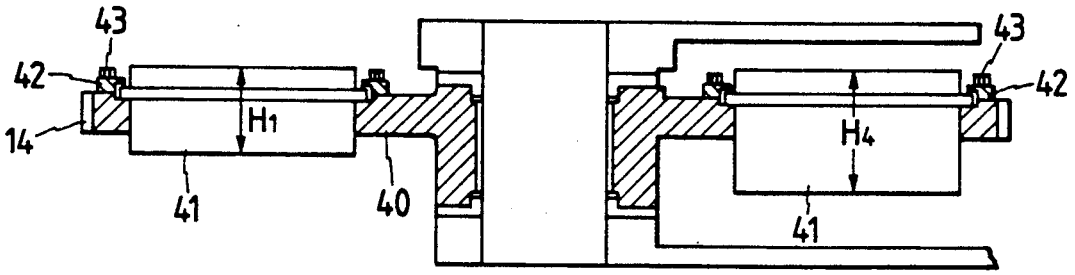
FIG. 5 is a partial cross sectional view of a modified plate.

The plates 13 in FIGS. 1 and 2 and 13, 13' of FIGS. 3 and 4 may be of unitary construction, or constructed with removable height portions as set forth in FIG. 5. Different height portions or pressure blocks 41 are replaceable assembled in a rotary frame 40 for each step portion of the rotary type step plate 13, 13'. A holder 42 consists of a half-split ring, for example, and the pressure block 41 is held by the ring and a bolt 43 that is screwed into the rotary frame 40 in the vertical direction. According to this structure, the pressure blocks H1–H6 for bearing the rolling load can be replaced by other blocks having different thicknesses and the freedom of the height adjustment can be improved. The pressure blocks 41 for bearing the rolling load must be made of very hard and rigid material in order to receive the high compression loading with great rigidity, in an environment where damage and wear is also high. Accordingly, the structure according to FIG. 5 is advantageous in that the pressure blocks can be replaced easily and economically when damaged or worn. The rotary frame 40 can be produced with lower cost material of less hardness and rigidity, and therefore the construction cost becomes lower and the maintenance cost becomes lower. The replaceable structure of FIG. 5 is in contrast to a structure wherein the different height portions H1–H6 are homogeneous with the remainder of the disc 13 or 13'.

Figure 6:
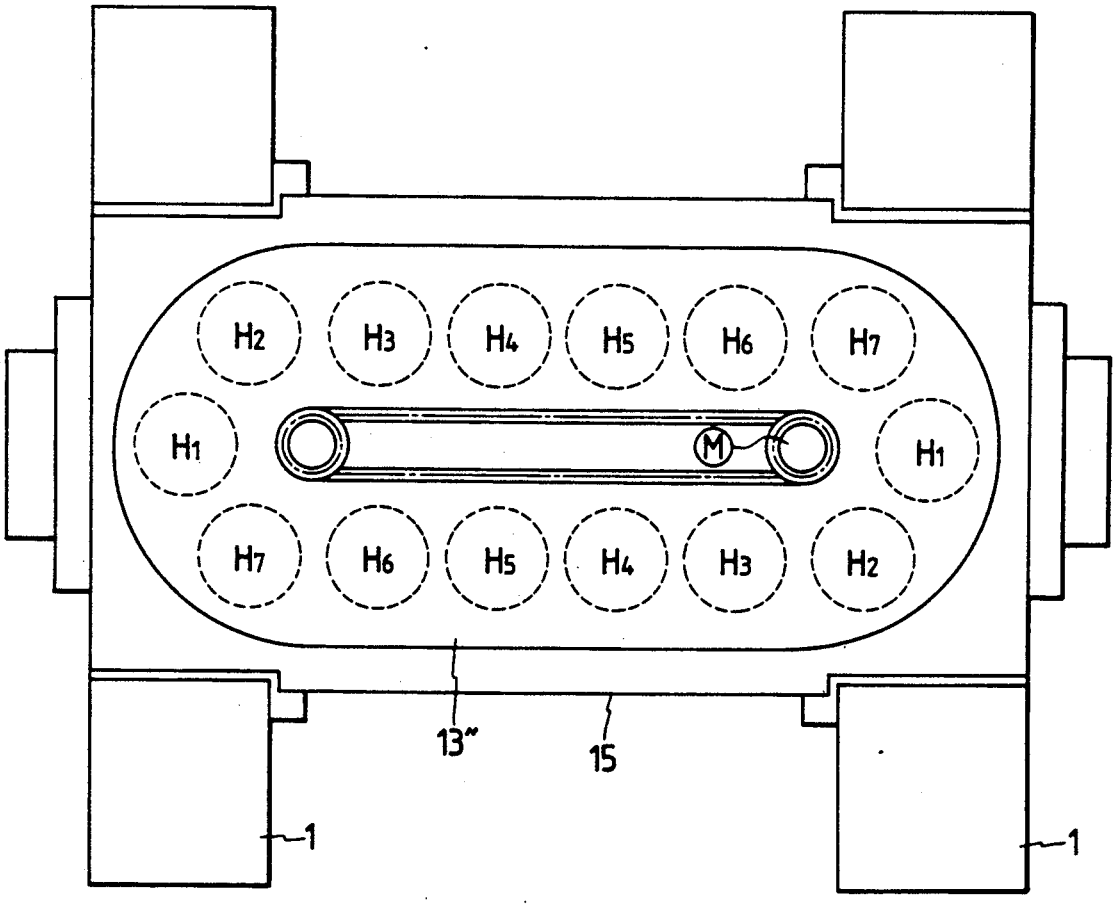
FIG. 6 is a view similar to FIGS. 2 and 4, but of a modified plate portion conveyer system.

Although the plate 13 and 13' described previously are shown to be of a disc or cylindrical shape, other rotary shapes are contemplated. For example, as shown in FIG. 6, the different height plate portions H1–H6, in two sets, can be mounted on a single endless conveyer to constitute a plate 13' common to both roll chocks 7, for example. Such endlessly movable conveyers are well known for other purposes and would be preferably driven by the indicated motor and two drive sprockets, as shown as a typical drive mechanism.

Figure 7:
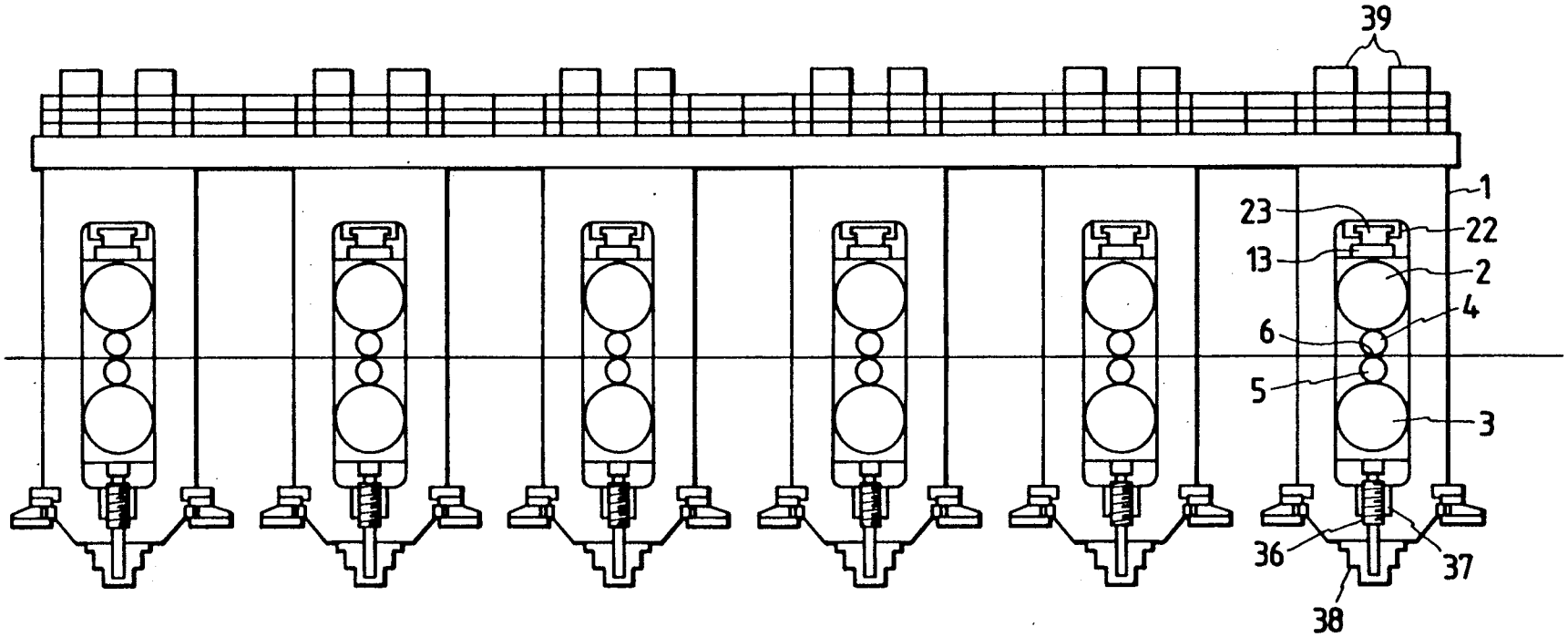
FIG. 7 shows a side view of a plural roll stand mill, wherein the roll stands may be constructed according to the present invention.

As shown in FIG. 7, the roll stands shown in the previously described figures may be duplicated along a pass line to provide a multi roll stand rolling mill. As shown in FIG. 7, a press up screw 36 and a press up nut 37 are disposed below the bearing box 8 of the lower backup roll 3. The apparatus, such as the hydraulic cylinder 22, rotary type step plate 13, etc., disposed at the upper part of the rolling mill according to FIGS. 1 and 2, and the upper surface of the lower work roll 5 can be adjusted arbitrarily with respect to the pass line. Height adjustment can be made by the press up motor, not shown, through a press up driving device 38 in order to compensate for variations in roll diameter of the upper and lower work rolls 5, 6 and the roll diameter of the upper and lower backup rolls 3, 4. Therefore, the oil column 25 of hydraulic cylinder 23 is made minimum by the combination of smooth rolling with the rotary type stepped plate 13 and the sink of the front and rear ends of rolled material can be prevented or at least reduced greatly.

Furthermore, since the rolling-reduction driving device 34 and the rolling reduction motor 35 at the upper portion of the conventional rolling mill shown in FIG. 8 can be eliminated according to the present invention, a large space can be secured at the upper part of the rolling mill and the hydraulic cylinder 32 and a valve stand 39, as shown in FIG. 7, for operating the oil pressure of the ram and perhaps also for operating the oil pressure for roll bending mechanisms (not shown), can be disposed in this space for each stand. That is, the valve stands can be mounted directly on the upper portion of the housing 1 immediately above the upper backup roll and immediately adjacent the hydraulic screw down adjusting ram to minimize oil line length and accordingly minimize effective oil volume within the cylinder. Therefore, the distance between the hydraulic cylinder and the valve stand for operating the oil pressure becomes within the range of 2 meters to about 10 meters and can be reduced drastically to about ¼ to about 1/25 of the distance in the conventional apparatus. The distance from the hydraulic cylinder to the valve stand for operating the oil pressure can be as great as 40 to 50 meters in a conventional rolling mill, because such valve stand may be entirely disposed below ground in an oil cellar. Accordingly, a response time can be improved drastically and the controllability of the sheet shape can be improved drastically too. Therefore, rolling having excellent product accuracy can be carried out.

Even though FIG. 7 shows a continuous rolling mill, the present invention is also effective for a single stand. Further, particularly as shown in FIGS. 2 and 4, the plate height adjustment mechanism of the present invention is contained substantially entirely within the footprint of the mill housing 1. The footprint is defined as the vertical projection of the housing upon a horizontal support surface. This has a result that the plate adjustment can be adequately supportive with respect to the housing so that it is usable with the high impact loading and high vibration encountered in hot rolling as described above. Further, with a rotary plate adjustment, the horizontal extent of the plates, for example H1-H6, is drastically reduced as compared to a linear array of the same plates in the horizontal direction according to the above mentioned prior art, and accordingly the rigidity and supportability of the plates is greatly improved as compared to the prior art so that such rotary plate adjustment is usable with high impact and high vibration particularly encountered in hot rolling.

While preferred embodiments along with variations and modifications have been set forth for disclosing the best mode and important details, further embodiments, variations and modifications are contemplated according to the broader aspects of the present invention, all as set forth in the spirit and scope of the following claims.

We claim:

1. A rolling mill comprising:
a pair of work rolls for rolling metal materials;
a pair of back up rolls for backing up said work rolls;
bearing boxes for storing bearings, each end of said back up rolls being rotatably supported by said bearing boxes;
a pair of housings being spaced in the axial direction of said work rolls and said back up rolls for fixedly supporting said bearing boxes;
means for adjusting a gap between said work rolls during a change of diameter of said work rolls, said adjusting means having a screw down height adjuster and a rotary step-wise variable height plate, each disposed between said housing and said bearing means; and
said rotary step-wise variable height plate having different height blocks substantially within the footprint of said housings for all adjustment positions of said plate.

2. A rolling mill according to claim 1, wherein said screw down height adjuster is comprised by a hydraulic cylinder.

3. The rolling mill according to claim 1, including means rotating said plate about at least one axis displaced inwardly of the housing away from the space between the housing and bearing means adjusted by the plate.

4. A rolling mill comprising:
a pair of work rolls for rolling metal materials;
a pair of back up rolls for backing up said work rolls;
bearing boxes for storing bearings, each end of said back up rolls are rotatably supported by said bearing boxes;
a housing for fixedly supporting said bearing boxes;
a hydraulic cylinder for adjusting a gap between said work rolls during a change of a diameter of said work rolls;
a movable plate of step-wise variable height with a plurality of different height plate portions, each of said portions being disposed between said bearing boxes and said housing for one position and for movement between a plurality of storage positions, each one position step-wise changing the spacing in the direction of the gap between said housing and said bearing boxes; and
means supporting said movable plate on said housing for moving the different height plate portions in a curved path that is substantially completely within the horizontal confines of said housing for all positions of said movable plate.

5. A rolling mill according to claim 4, including means rotating said plate about at least one axis displaced inwardly of the housing away from the space between the housing and bearing boxes adjusted by the plate.

6. A rolling mill comprising:
a pair of work rolls for rolling metal materials;
a pair of back up rolls for backing up said work rolls;
bearing boxes for storing bearings, each end of said back up rolls being rotatably supported by said bearing boxes;
a housing for fixedly supporting said bearing boxes; and
an adjusting means for adjusting a gap between said work rolls during a change of diameter of said work rolls, said adjusting means having a screw down height adjuster and step-wise variable height movable plate height adjuster with a plurality of different height plate portions, and means supporting said movable plate on said housing for moving the different height plate portions in a curved path that is substantially completely within the horizontal confines of said housing for all adjustment positions of said movable plate.

7. A rolling mill according to claim 6, including means rotating said plate about at least one axis displaced inwardly of the housing away from the space between the housing and bearing boxes adjusted by the plate.

8. A rolling mill, comprising:
a pair of work rollers having parallel axes arranged to produce a gap for receiving therebetween sheet material to be rolled;
backup roll means having parallel axes and being on the sides of said work rolls opposite from said gap for backing up said work rolls and having backup roll chocks;
stationary housing means receiving therein said work rolls and said backup roll means;
screw-down adjustment means for adjusting the gap between said work rolls; and plate means in adjustment series and separate from said screw-down adjustment means for additionally adjusting said gap, having a plurality of step plate portions of variable height, as measured in the direction of said gap, rotatably mounted in a plane parallel to the axes of said work rolls and backup rolls to selectively insert different step height plate portions of said plate effectively between the roll chocks and said housing, on at least one side of said gap.

9. The rolling mill according to claim 8, wherein a single said plate is rotatable to simultaneously place different height portions of said plate respectively between the opposed roll chocks of one of said backup rolls and said housing.

10. The rolling mill according to claim 8, wherein said plate includes a plurality of separately removable and replaceable plate portions of different height arranged in an endless array.

11. The rolling mill according to claim 10, wherein said plate means includes an endless conveyer carrying therein said plate portions, and said plate portions being of a metal of substantially greater hardness than said carrier.

12. The rolling mill according to claim 8, wherein said screw-down means is hydraulic and comprises a hydraulic ram effectively mounted between said housing and said roll chocks on opposite sides of at least one of said backup rolls.

13. The rolling mill according to claim 12, wherein said plate means is operatively positioned between each of said hydraulic rams and the adjacent roll chock of said one backup roll.

14. The rolling mill according to claim 8, further including liner plates;

means mounting said liner plates between said backup roll chocks and said housing for removal and replacement only upon removal of said backup rolls; and said plate means moving different plate thickness portions from a storage position into an operative position while maintaining such backup rolls operatively within said housing without removable, so that said plate means may be used for gross adjustments during change of working rolls.

15. The rolling mill according to claim 8, all of said plate means portions lying within the footprint of said housing.

16. The rolling mill according to claim 8, wherein said rolling mill is a hot-strip rolling mill.

17. The rolling mill according to claim 8, wherein said plate means is rotatable about at least one axis spaced inwardly of the housing from the inserted plate portion and spaced from each of said roll chocks.

18. A rolling mill, comprising:

a pair of work rollers having parallel axes arranged to produce a gap for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

plate means in adjustment series and separate from said screw-down adjustment means for additionally adjusting said gap, having a plate of variable height, as measured in the direction of said gap, rotatably mounted in a plane parallel to the axes of said work rolls and backup rolls to selectively insert different height portions of said plate effectively between the roll chocks and said housing, on at least one side of said gap; and wherein said plate means includes two separate plates and means simultaneously rotating said plates for placing respective height portions of said two plates between the opposed roll chocks of one of said backup rolls on one side of said gap and said housing.

19. A rolling mill, comprising:

a pair of work rollers having parallel axes arranged to produce a gap for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls; and plate means in adjustment series and separate from said screw-down adjustment means for additionally adjusting said gap, having a plate of variable height, as measured in the direction of said gap, rotatably mounted in a plane parallel to the axes of said work rolls and backup rolls to selectively insert different height portions of said plate effectively between the roll chocks and said housing, on at least one side of said gap, wherein said plate is a rigid circular plate step-wise variable in height around its periphery.

20. A rolling mill, comprising:

a pair of work rollers having parallel axes arranged to produce a gap for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

plate means in adjustment series and separate from said screw-down adjustment means for additionally adjusting said gap, having a plate of variable height, as measured in the direction of said gap, rotatably mounted in a plane parallel to the axes of said work rolls and backup rolls to selectively insert different height portions of said plate effectively between the roll chocks and said housing, on at least one side of said gap, wherein said screw-down means is hydraulic and comprises a hydraulic ram effectively mounted between said housing and said roll chocks on opposite sides of at least one of said backup rolls;

control means monitoring said gap and providing a control signal; and means responsive to said control signal for correspondingly varying the quantity of working fluid within said hydraulic rams during rolling, with said hydraulic rams providing fast control response time and said plate means providing gross adjustments during work roll change with higher rigidity than said ram means, and said ram means providing control adjustments at a speed greater than said plate means.

21. The rolling mill according to claim 20, further including liner plates;

means mounting plates between said backup roll chocks and said housing for removal and replacement only upon removal of said backup rolls; and said plate means moving different plate thickness portions from a storage position into an operative position while maintaining such backup rolls operatively within said housing without removal, so that said plate means may be used for gross adjustments during change of working rolls.

22. The rolling mill according to claim 20, all of said plate means portions lying within the footprint of said housing.

23. A rolling mill, comprising:

a pair of work rollers having parallel axes and arranged to produce a gap for a strip pass line for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

plate means in adjustment series and separate from said screw-down adjustment means for additionally adjusting said gap, having variable height, as measured in the direction of said gap and mounted to selectively insert different height portions effectively between the roll chocks of said backup rolls and said housing, on at least one side of said gap;

said housing having a footprint, as seen in a plane parallel to the strip pass line in said gap;

said plate means moving said variable height portions in a curved path substantially only within the footprint of said housing for all adjustments of said plate means, the curved path having arcuate portions whose centers of curvature are outside of the space between the roll chocks and housing, and within the footprint; and conveyor means between said portions and said housing ruggedly supporting said portions that are not between said housing and said backup roll chocks stable against the vibration and shocks of rolling.

24. The rolling mill according to claim 23, wherein said plate means has a plurality of plate portions of different step thicknesses selectively insertable between storage positions away from between said roll chocks and said housing and an operative position between said roll chocks and said housing, with said storage positions being entirely within the footprint of said housing.

25. The rolling mill according to claim 23, further including liner plates;

means mounting said liner plates between said backup roll chocks and said housing for removal and replacement only upon removal of said backup rolls; and said plate means moving different plate thickness portions from a storage position into an operative position while maintaining such backup rolls operatively within said housing without removable, so that said plate means may be used for gross adjustments during change of working rolls.

26. The rolling mill according to claim 23, said plate means include a single rigid disc having said plurality of portions mounted in a circular array around its periphery, said disc being rotatably mounted about its center that is between both of and spaced from each of the roll chocks of the same back up roll and having motor means for rotating said disc.

27. A rolling mill, comprising:

a pair of work rollers having parallel axes and arranged to produce a gap for a strip pass line for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

plate means in adjustment series and separate from said screw-down adjustment means for additionally adjusting said gap, having variable height, as measured in the direction of said gap and mounted to selectively insert different height portions effectively between the roll chocks of said backup rolls and said housing, on at least one side of said gap;

said housing having a footprint, as seen in a plane parallel to the strip pass line in said gap;

said plate means moving said variable height portions in a path substantially only within the footprint of said housing and conveyor means between said portions and said housing ruggedly supporting said portions that are not between said housing and said backup roll chocks stable against the vibration and shocks of rolling;

wherein said screw-down means is hydraulic and comprises a hydraulic ram effectively mounted between said housing and said roll chocks on opposite sides of at least one of said backup rolls;

control means monitoring said gap and providing a control signal; and means responsive to said control signal for correspondingly varying the quantity of working fluid within said hydraulic rams during rolling, with said hydraulic rams providing fast control response time and said plate means providing gross adjustments during work roll change with higher rigidity than said ram means, and said ram means providing control adjustments at a speed greater than said plate means.

28. A rolling mill, comprising:

a pair of work rollers having parallel axes and arranged to produce a gap for a strip pass line for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

first plate means in adjustment series and separate from said screw-down adjustment means for additionally adjusting said gap, having a first array of plate portions of different height, as measured in the direction of said gap and mounted to selectively insert different height portions effectively between each of the roll chocks of at least one of said backup rolls and said housing, on at least one side of said gap; and second plate means in adjustment series and separate from said screw-down adjustment means for additionally adjusting said gap having a second array of plate portions of different height different with respect to each other, mounted to be selectively movable into operative position in tandem with said first plate means portions independently of movement of said first plate means portions, so that the number of combinations of tandem plate portions in the operative position in the gap direction may be equal to the multiple of the number of different height plate portions in said first plate means and said second plate means.

29. A method of hot rolling metal between a pair of horizontally extending work rolls supported in a stationary housing having a footprint, the footprint being defined by a vertical projection of the housing upon a horizontal support surface, the method comprising the steps of:

hot rolling metal between a pair of work rolls supported by backup rolls having backup roll chocks held in the stationary housing;

adjusting the gap between the work rolls during rolling with hydraulic rams;

changing the work rolls with work rolls of different diameters without removing the back up rolls and adjusting for the difference in work roll diameters by selectively inserting connected different height rigid plate portions effectively between the housing and each end of the back up roll chocks for at least one back up roll thereby minimizing the volume of fluid in the hydraulic rams, with gross adjustments during work roll change being accomplished by the plate adjustment to maximize the stiffness of the work rolls; and during said step of hot rolling, maintaining a common drive for the connected unused rigid plate portions substantially within the footprint of the housing and sufficiently rigidly supporting the unused rigid plate portions so that the common drive and unused rigid plate portions do not overhang from the housing so as to reliably withstand the considerably greater shock and vibrations of hot rolling as compared to cold rolling.

30. A rolling mill, comprising:

a pair of work rollers having parallel axes arranged to produce a gap for receiving therebetween sheet material to be rolled;

backup roll means having parallel axes and being on the sides of said work rolls opposite from said gap for backing up said work rolls and having backup roll chocks;

stationary housing means receiving therein said work rolls and said backup roll means;

screw-down adjustment means for adjusting the gap between said work rolls;

plate means in adjustment series and separate form said screw-down adjustment means for additionally adjusting said gap, having a plate of variable height, as measured in the direction of said gap, rotatably mounted in a plane parallel to the axes of said work rolls and backup rolls to selectively insert different height portions of said plate effectively between the roll chocks and said housing, on at least one side of said gap; and said plate means having at least one center of rotation spaced from and between the roll chocks of the work roll adjusted thereby so as to move the different height portions that are not between the roll chocks and housing into and out of storage positions between the roll chocks.

31. The rolling mill according to claim 30, wherein said plate means is a rigid circular plate having a center of rotation lying in a plane passing through the axes of rotation of said work rollers.

32. The rolling mill according to claim 30, wherein said plate includes a plurality of separately removable and replaceable plate portions of different height arranged in an endless array.

33. The rolling mill according to claim 30, wherein said screw-down means is hydraulic and comprises a hydraulic ram effectively mounted between said housing and said roll chocks on opposite sides of at least one of said backup rolls.

34. The rolling mill according to claim 33, wherein said plate means is operatively positioned between each of said hydraulic rams and the adjacent roll chock of said one backup roll.

35. The rolling mill according to claim 30, all of said plate means portions lying within the footprint of said housing.

36. The rolling mill according to claim 30, wherein said rolling mill is a hot-strip rolling mill.

37. The rolling mill according to claim 30, wherein said plate is circular and continuously variable in height around its entire periphery in the shape of a wedge.

* * * * *